US008807199B2

(12) United States Patent
Bushby

(10) Patent No.: US 8,807,199 B2
(45) Date of Patent: Aug. 19, 2014

(54) LIQUID PRESSURE FORMING

(75) Inventor: Roger Stanley Bushby, Hampshire (GB)

(73) Assignee: Composite Metal Technology Ltd., Hampshire (GB)

( * ) Notice: Subject to any disclaimer, the term of this patent is extended or adjusted under 35 U.S.C. 154(b) by 1364 days.

(21) Appl. No.: 10/599,765

(22) PCT Filed: Aug. 12, 2004

(86) PCT No.: PCT/GB2004/003382

§ 371 (c)(1),
(2), (4) Date: Nov. 17, 2006

(87) PCT Pub. No.: WO2005/097377

PCT Pub. Date: Oct. 20, 2005

(65) Prior Publication Data

US 2008/0264595 A1 Oct. 30, 2008

(30) Foreign Application Priority Data

Apr. 8, 2004 (GB) ..... 0408044.6

(51) Int. Cl.

| | |
|---|---|
| ***B22D 18/02*** | (2006.01) |
| ***B22D 27/11*** | (2006.01) |
| ***B22D 19/14*** | (2006.01) |
| ***C22C 47/12*** | (2006.01) |
| ***B22D 18/04*** | (2006.01) |

(52) U.S. Cl.

CPC ..... *B22D 19/14* (2013.01); *C22C 47/12* (2013.01); *B22D 18/04* (2013.01); *B22D 27/11* (2013.01)

USPC ..... 164/120; 164/319

(58) Field of Classification Search

USPC ..... 164/120, 319–320; 425/77, 129.1, 410, 425/411, 451.9; 249/95

See application file for complete search history.

(56) References Cited

U.S. PATENT DOCUMENTS

| | | | | |
|---|---|---|---|---|
| 4,573,519 | A * | 3/1986 | Donomoto et al. | 164/97 |
| 4,662,429 | A | 5/1987 | Wada et al. | |
| 5,097,887 | A | 3/1992 | Schmid et al. | |
| 5,234,045 | A | 8/1993 | Cisko | |
| 5,433,262 | A | 7/1995 | Kawaguchi et al. | |
| 5,746,267 | A | 5/1998 | Yun et al. | |
| 5,887,643 | A * | 3/1999 | Nakamura et al. | 164/340 |
| 6,298,903 | B1 | 10/2001 | Wyser et al. | |
| 6,360,809 | B1 * | 3/2002 | Cornie et al. | 164/65 |

FOREIGN PATENT DOCUMENTS

| | | |
|---|---|---|
| DE | 19508867 | 12/1995 |
| EP | 0373093 AZ1 | 6/1990 |
| GB | 2115327 | 9/1983 |
| GB | 2373562 A | 9/2002 |
| JP | 58093557 | 6/1983 |
| JP | 60152353 | 8/1985 |
| JP | 62-72756 | 5/1987 |

(Continued)

*Primary Examiner* — Kevin P Kerns

(74) *Attorney, Agent, or Firm* — Kilpatrick Townsend & Stockton LLP

(57) ABSTRACT

A method of pressure forming a metal matrix composite (MMC), comprises: placing a fiber preform (not shown) into a die cavity (14) defined by a split die (12); introducing molten metal into the die cavity (14) through a sprue (16) to envelope the fiber preform; sealing the sprue (16); applying pressure direct to molten metal in the die cavity (14) with a mechanical compaction piston (18) to encourage infiltration of the fiber preform during solidification.

6 Claims, 4 Drawing Sheets

(56) References Cited

FOREIGN PATENT DOCUMENTS

| | | | |
|---|---|---|---|
| JP | 62-156066 | * | 7/1987 |
| JP | 62-238062 | * | 10/1987 |
| JP | 10-061765 A | | 3/1989 |
| JP | 62-049073 A | | 3/1989 |
| JP | 2-113170 A | | 4/1990 |
| JP | 05329610 | | 12/1993 |
| JP | 06304736 | | 11/1994 |
| JP | 09076052 | | 3/1997 |
| WO | WO 02/27049 A3 | | 4/2002 |

* cited by examiner

LIQUID PRESSURE FORMING

The present invention relates to a method of pressure forming a metal matrix composite, apparatus therefor, and also to a novel die for use in pressure forming metal matrix composites.

Metal matrix composites (MMCs) are composed of a metal matrix and a reinforcement, or filler material, which confers excellent mechanical performance, and can be classified according to whether the reinforcement is continuous (monofilament or multifilament) or discontinuous (particle, whisker, short fibre or other). The principal matrix materials for MMCs are aluminium and its alloys. To a lesser extent, magnesium and titanium are also used, and for several specialised applications a copper, zinc or lead matrix may be employed. MMCs with discontinuous reinforcements are usually less expensive to produce than continuous fibre reinforced MMCs, although this benefit is normally offset by their inferior mechanical properties. Consequently, continuous fibre reinforced MMCs are generally accepted as offering the ultimate in terms of mechanical properties and commercial potential.

A basic process for casting fibre reinforced metals is described in U.K. patent specification GB 2115327. As a licensee under the patent, the present applicant developed the basic process into a full scale liquid pressure forming (LPF) process. In the LPF process, a pre-heated preform (fibres, short fibres, porous media or particulate) is placed in a heated die, which is closed and locked using a mechanical toggle system. The die and molten metal in a crucible housed in a pressure vessel are then subjected to a high vacuum. When the evacuation is complete, molten metal is transferred from the crucible into the die through a sprue fed by a riser tube by the introduction of nitrogen gas into the pressure vessel. The molten metal takes up the shape of the die, which can be complex, and largely infiltrates the preform. Once the die is filled with molten metal, a hydraulic compaction piston is used to seal the top of the riser tube and further consolidate the casting to encourage maximum infiltration of the preform and to consolidate the shrinking matrix during metal solidification. The resulting composite is then ejected from the die.

According to leading authorities in the field of materials' science, the LPF process is one of the most efficient and cost-effective methods of manufacturing MMCs, and represents a significance technological advance in the commercialisation of these composite materials. In particular, achieving total cycle times in the range 2 to 5 minutes is one of many significant advantages over other fabrication routes for MMCs. Nevertheless, the present applicants have sought to improve upon the LPF process to promote commercial viability.

In accordance with a first aspect of the present invention, there is provided a method of pressure forming a metal matrix composite, comprising: placing a fibre preform into a die cavity; introducing molten metal into the die cavity through a sprue to envelope the fibre preform; sealing the sprue; applying pressure to molten metal in the die cavity with a mechanical compaction piston to encourage infiltration of the fibre preform; characterised in that the mechanical compaction piston is configured to apply pressure direct to molten metal in the die cavity during solidification.

During the process, pressure is applied direct to a body of liquid metal within the die cavity which will remain liquid until after other molten metal in the die cavity has solidified. The die may even be configured so that during solidification a solid/liquid interface migrates towards the body of liquid pressurized by the mechanical compaction piston. For example, the mechanical compaction piston may be configured to act upon the body of liquid at one end (e.g. top) of the die cavity, and the solid/liquid interface may in use travel from an opposing end (e.g. bottom) of the die cavity towards the other end. In this way, there is no loss of the hydrostatic pressure state experienced by molten metal in the die cavity until solidification is substantially complete, and this improves the degree of metal infiltration into the preform and consolidation in general as compared to results obtained with the LPF process. One reason for this is that, in the LPF process, the hydraulic compaction piston only acted indirectly on molten metal in the die cavity via molten metal in the sprue. Premature or early solidification of molten metal in the sprue resulted in a loss of the hydrostatic pressure state experienced in the die cavity, limiting the effectiveness of the compaction piston. This is not the case with the present invention where pressure is applied independently of the sprue.

The mechanical compaction piston may be configured to travel towards the die cavity (e.g. a central part of the die cavity) when applying pressure to molten metal in the die cavity. The mechanical compaction piston may even project into the die cavity during solidification of molten metal therein. In this way, molten metal inside the die cavity may be mechanically displaced by the mechanical compaction piston when applying pressure to the molten metal. The mechanical compaction piston may apply pressures in excess of 150 bar (15 $N/mm^2$), perhaps in the range 400 to 2500 bar (for example 1500 bar) to molten metal in the die cavity during preform infiltration and subsequent solidification. The mechanical compaction piston may be mounted on a moving platen to which one part of the die is attached. Advantageously, the mechanical compaction piston may also be configured to eject the solidified metal matrix composite from the die cavity once split to facilitate its removal.

The method may further comprise evacuating the die cavity prior to introducing molten metal therein. The method may also comprise depressurizing the molten metal prior to its introduction into the die cavity. Depressurizing may degas the molten metal. Evacuating the die cavity and degassing the molten metal may be performed independently via separate pathways. The molten metal may be introduced into the die cavity under a gas pressure differential or overpressure, for example, caused by inert gas acting on the molten metal in a pressure vessel. The pressure differential may be less than 50 bar, perhaps 10 bar, and may be applied at a controlled rate such that molten metal fills the die in a quiescent (slow and non-turbulent) manner, which may confer improved properties in the solidified component.

In one embodiment, the sprue may be sealed using a sliding valve member. The sliding valve member may be mounted on a piston (e.g. side acting piston) which slides the valve member across the sprue to seal it. The piston may travel transversely to the sprue. Any positive gas pressure on molten metal in the pressure vessel may be removed (e.g. by venting the pressure vessel to atmosphere).

In accordance with another aspect of the present invention, there is provided apparatus for liquid pressure forming a metal matrix component, comprising: a die defining a die cavity for receiving a fibre preform, and a sprue for channelling molten metal into the die cavity; and a mechanical compaction piston configured to apply pressure direct to molten metal in the die cavity during solidification.

The mechanical compaction piston may be configured to travel towards the die cavity when applying pressure to molten metal in the die cavity. The mechanical compaction piston may be configured to project into the die cavity when applying such pressure. Other features of the mechanical compaction may be equivalent to those of the mechanical compaction piston of the first aspect of the invention.

The apparatus may further comprise a pressure vessel for housing molten metal. The pressure vessel may include a furnace for melting metal. The die cavity may be airtight and the die cavity and pressure vessel may have independent pathways for evacuating gas from each. The pressure vessel may have a conduit for channelling molten metal housed therein to the sprue. The conduit may include a riser tube, one end of which is configured to extend into molten metal housed in the pressure vessel.

The die may be a split die and may include electrical resistance heating. The die may comprise: a first part defining at least part of the die cavity with at least one external opening; and a second part defining a chamber for housing the first part, the chamber having at least one opening which is registrable with the at least one external opening of the first part when housed in the second part. One chamber opening may be configured as the sprue for introducing molten metal into the die cavity of the first part when housed in the second part. The second part may also define part of the die cavity and may be configured to receive the mechanical compaction piston during solidification.

In accordance with yet another aspect of the present invention, there is provided a method of casting a component from a metal having a liquidus temperature, comprising: providing a die comprising: a first part defining at least part of a die cavity with an external opening; and a second part defining a chamber for housing the first part, the chamber having an opening which is registrable with the external opening of the first part when housed in the second part; heating the first part of the die to a temperature above the liquidus temperature of the metal whilst maintaining the second part of the die at a temperature below the liquidus temperature of the metal; placing the first part of the die in the chamber of the second part with the chamber opening registered with the external opening of the first part; introducing molten metal into the die cavity through the chamber opening; and solidifying molten metal in the die cavity.

The two-part or duplex die is particularly useful in liquid pressure forming metal matrix components as hereinbefore described where normally high die temperatures have to be maintained to prevent premature solidification of the metal matrix and so avoid incomplete infiltration, poor consolidation and matrix porosity. The metal may further comprise removing the first part of the die from the second part after solidification, and cooling the first part independently of the second part before removing the solidified component. Whilst the first part is cooling independently of the second part, another part corresponding to the first part may be prepared and the above method repeated. In this way, fast casting cycle times are achievable, whilst ensuring cast component quality is not prejudiced by premature stripping from its die.

The first and second parts of the die may each comprise at least two sections so that each part may be split, either to remove the cast component from the first part or to remove the first part from the second part. The sections of one part may be configured to separate in a different direction to sections of the other part, for example, the two directions may be substantially perpendicular. The first part may have a profile which tapers in one or more directions to facilitate release from the second part. The first part may be bi-conical or bi-frustoconical.

When the metal comprises aluminium, the first part of the die may be heated to about 800° C., whilst the second part may be maintained at a temperature of about 300° C. to 500° C., say 400° C.

Embodiments of the various aspects of the invention will now be described by way of example with reference to the accompanying drawings in which:

FIG. 1 illustrates apparatus embodying the present invention for pressure forming a metal matrix composite;

FIGS. 2*a*-2*d* illustrate schematically four key stages in pressure forming a metal matrix composite using the apparatus of FIG. 1;

Figure 1:
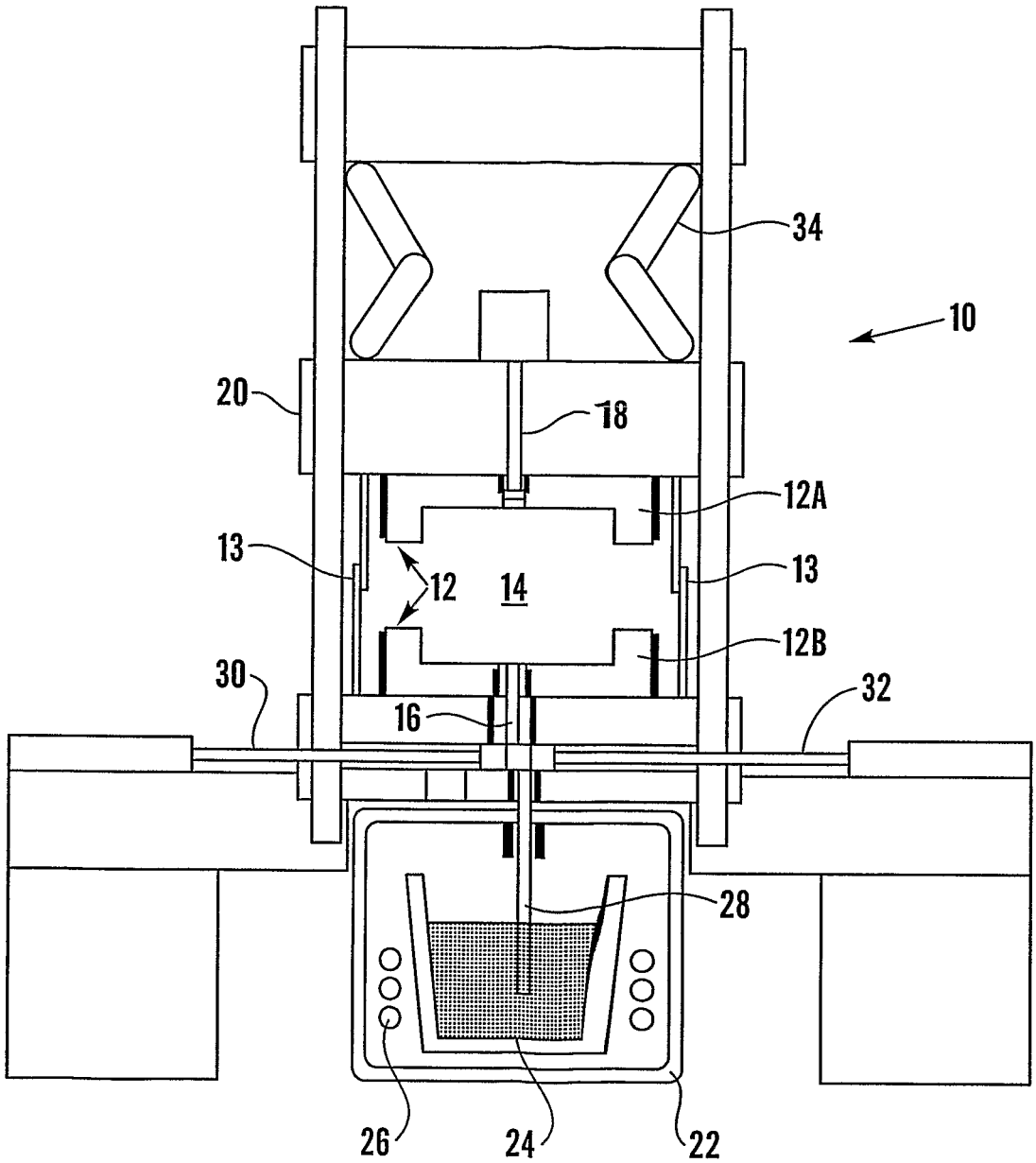
Figure 2A:
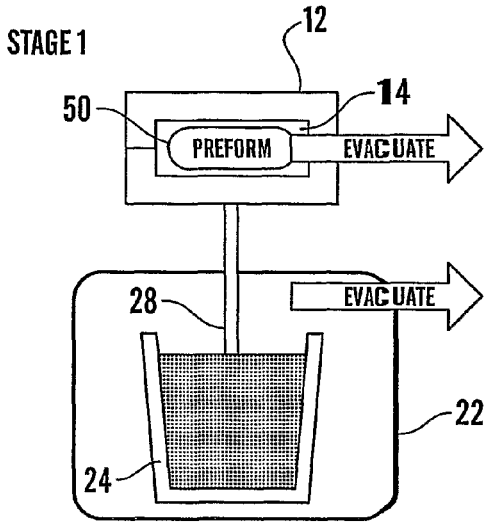
Figure 2B:
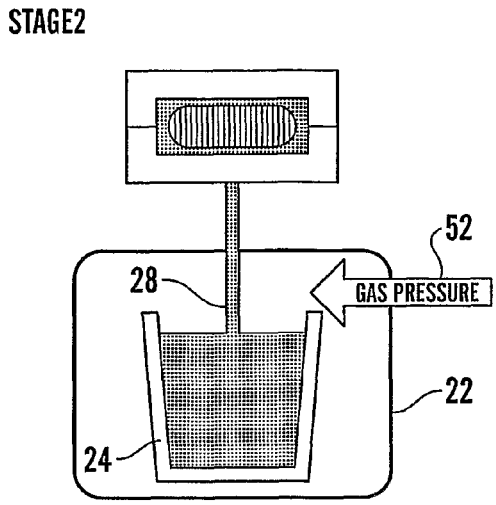
Figure 2C:
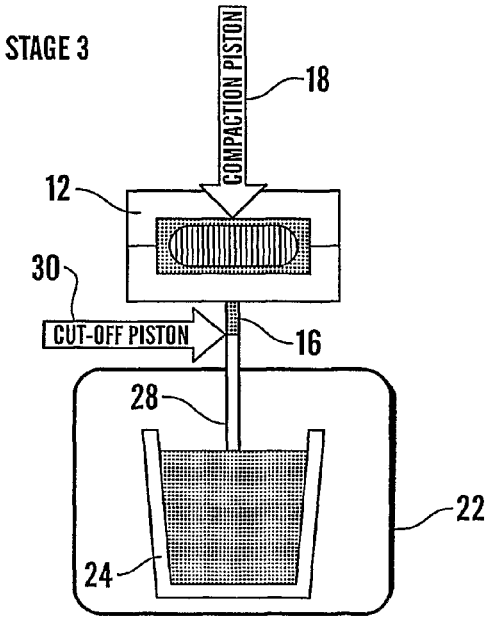
Figure 2D:
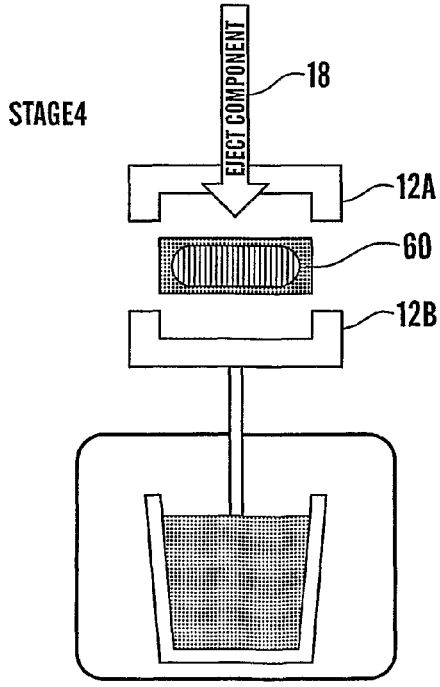

FIG. 1 illustrates apparatus (10) for pressure forming a metal matrix composite (MMC) according to one embodiment of the present invention. The apparatus (10) comprises a split die (12) defining a die cavity (14) for receiving a fibre preform (not shown) and a sprue (16) for channelling molten metal into the die cavity (14). A mechanical compaction piston (18) is mounted on top moving platen (20) and is configured to apply pressure direct to molten metal in the die cavity (14) during solidification.

The apparatus (10) further comprises a furnace pressure vessel (22) which, in use, houses a crucible (24) containing molten metal (e.g. aluminium). The crucible (24) is heated by heaters (26). In use, one end of a riser tube (28) is positioned in the crucible (24) and submerged beneath the level of molten metal contained therein. The other end of the riser tube (28) is in fluid communication with the sprue (16). A side-acting cut-off piston (30) is provided to block fluid communication between the riser tube (28) and the sprue (16) when required. Facing the cut-off piston (30), a slug ejector piston (32) is provided to eject solidified "slugs" of metal, formed by the cut-off piston (30) blocking fluid communication, which would otherwise become trapped between the riser tube and sprue. The operation of the apparatus of FIG. 1 will now be described with reference to the schematic drawings of FIG. 2.

Stage 1 includes placing a hot fibre preform (50) into the pre-heated, horizontally-split die cavity (14) of die (12). The die parts (12A,12B) are brought into close proximity (~10 mm apart) bellows (13) are closed, and the die cavity (14) and bellows (13) are evacuated down to a pressure of about 25 mbar. At the same time, the pressure vessel (22)—containing a crucible (24) of molten aluminium—is evacuated which acts to degas the melt. The bellows (13) and pressure vessel (22) are evacuated at the same rate to avoid any pressure differential which would otherwise result in metal either splashing in the crucible (24), as air is drawn down the riser tube (28), or flooding of the open die area as metal is drawn up the riser tube under the action of a net positive pressure.

At the beginning of Stage 2, the die parts (12A,12B) are clamped together via typically a 280 tonnes toggle press (34), and low-oxygen, nitrogen gas (52) enters the pressure vessel (22) in a controlled manner. The nitrogen gas in the pressure vessel (22) exerts a positive pressure on the surface of the molten aluminium in the crucible (24), forcing it up the riser tube (28) and through sprue (16). The molten aluminium enters the die cavity (14), preferably in a quiescent manner, and envelopes the fibre preform (50). The pressure of the nitrogen gas is then increased over the next 30 seconds to a maximum of 22 bar to increase molten aluminium infiltration of the fibre preform.

Stage 3 commences with the cut-off piston (30) sealing the sprue (16) from the riser (28). The nitrogen gas pressure in the pressure vessel (22) is vented to atmosphere, causing residual molten aluminium in riser tube (28) to flow back into the crucible (24). At the same time, the molten aluminium in the die cavity experiences a direct pressure of up to 1500 bar from actuation of the mechanical compaction piston (18). In this way, a high degree of infiltration and consolidation is achieved, even compensating for shrinkage on solidification. The direct pressure is applied for perhaps 20 to 90 seconds, depending on component size. Once the solidified metal matrix component (60) has cooled to a temperature where it has sufficient mechanical integrity, the two parts of the die (12A,12B) are separated and the component ejected by further actuation of the mechanical compaction piston (18) as shown in Stage 4. During the cooling stage, a solidified "slug" of metal is ejected by combined action of the side-acting pistons (30, 32).

Figure 3:
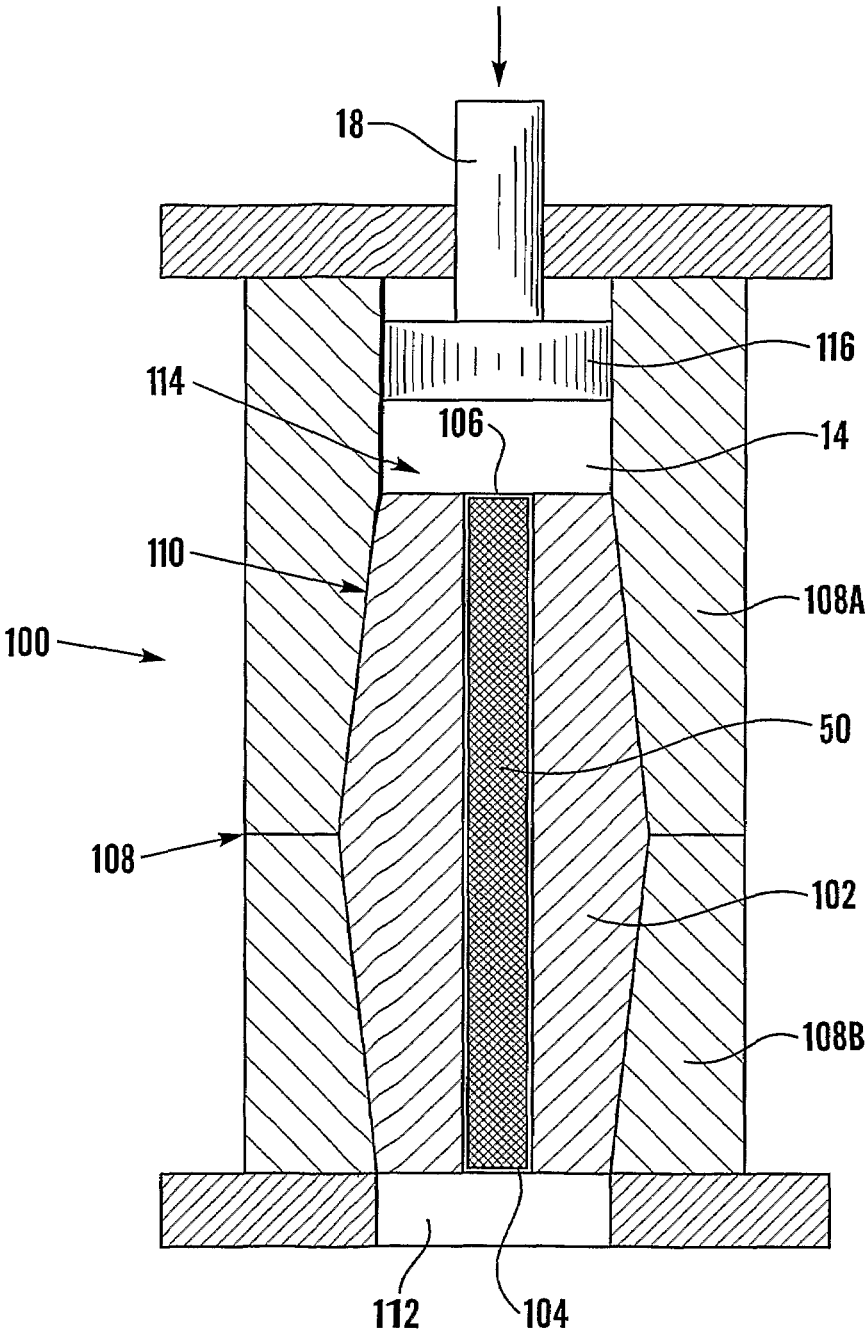
FIG. 3 illustrates die detail of the apparatus of FIG. 1.

FIGS. 1 and 2 illustrate the apparatus and process embodying the present invention with a standard-type split die (12). This may be replaced by the duplex die (100) which is shown in FIG. 3 and which embodies another aspect of the present invention. For ease of reference, features in common between the two arrangements share the same reference number.

The duplex die (100) comprises: a first (inner) part or cassette (102) defining at least part of the die cavity (14) with external openings (104,106) at opposed ends thereof; and a second (outer) part (108) defining a chamber (110) for housing the first part (102). The inner part (102) is split lengthwise to allow subsequent removal of cast components, and the outer part (108) is split laterally to allow removal of the inner part (102). The chamber (110) has an opening (112) which communicates with the lower external opening (104) of the first part (102), and which in use communicates with sprue (16). The chamber (110) also defines a head region (114) of the die cavity (14) which communicates with the upper external opening (106) of the first part (102), and which accommodates the moving head (116) of the compaction piston (18).

Figure 4:
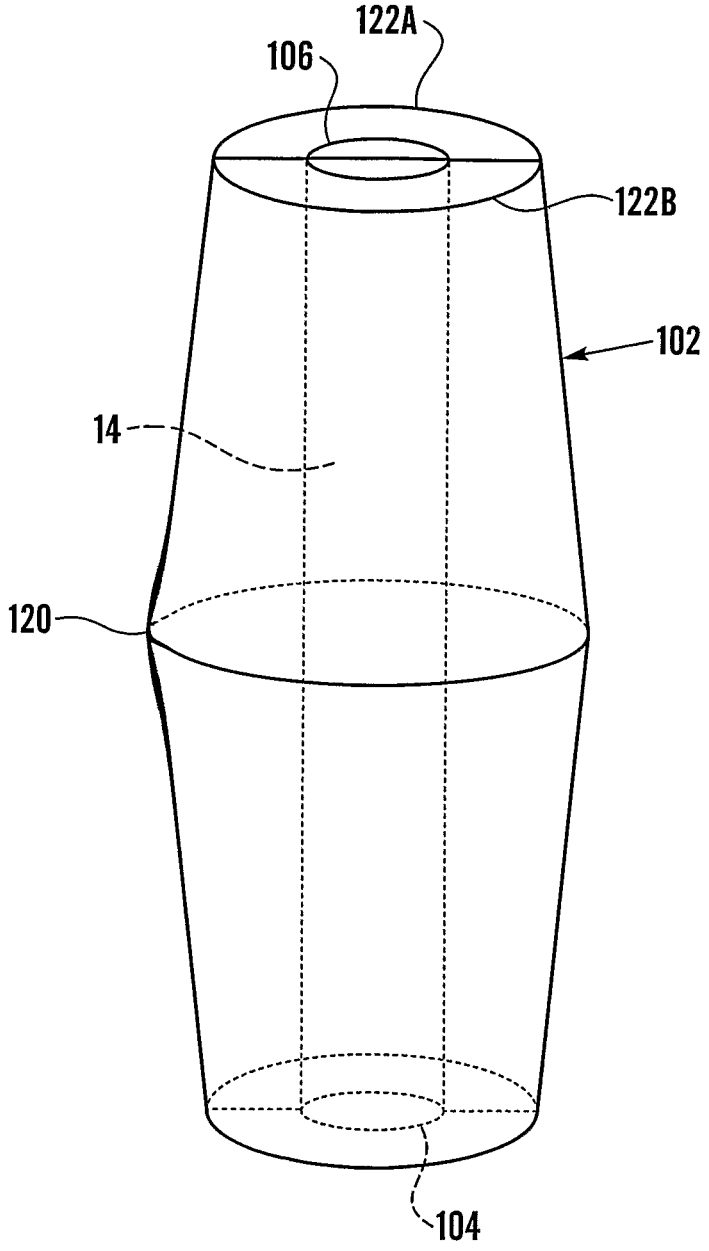
FIG. 4 illustrates further detail of the die of FIG. 3.

The duplex die (100) would be used to cast aluminium matrix composite components as follows. First, the first of cassette part (102) containing the fibre preform (50) would be heated to a temperature of about 800° C. (above the liquidus temperature of the aluminium), whilst the second part (108) would only be heated to about 400° C. (below the liquidus temperature of the aluminium). The first part (102) would then be positioned within the chamber (110) of the second part (108) of the die (100) with the apertures (104,106) registered with the opening (112) and head region (114) respectively. Next, molten aluminium is introduced through opening (112) under gas pressure (communicating with or even forming part of sprue (16)) into and through the opening (104) in the first part (102). The molten metal envelopes and largely infiltrates the preform (50) as it fills the cavity (14), flowing out of opening (106) into the head region (114). Once the sprue (16) is sealed, the head (116) of compaction piston (18) applies pressure to molten metal in the die cavity (14), and the molten metal is allowed to cool. As soon as the metal has solidified, the inner part (102) of the die is ejected from the outer part (10B) by splitting the two halves (108A, 108B) of the latter, and allowed to cool further. During the subsequent cooling stage, the inner part (102) supports the freshly solidified casting, ensuring its integrity is not jeopardised by premature removal from the outer part (108). Once the mechanical integrity of the cast component is established, it is stripped by separating two halves of the first part (102). As shown in FIG. 4, the first part (102) tapers towards each end from a median plane (120). Each tapering portion is frusto-conical. The first part (102) is formed in two sections (122A, 122B) which meet in a vertical plane.

The invention claimed is:

1. A method of casting a component from a metal having a liquidus temperature, comprising the steps of:

a) providing a die comprising: a first part defining at least part of a die cavity with an external opening; and a second part defining a chamber for housing the first part, the chamber having an opening which is registrable with the external opening of the first part when housed in the second part;

b) heating the first part of the die to a temperature above the liquidus temperature of the metal whilst maintaining the second part of the die at a temperature below the liquidus temperature of the metal;

c) placing the first part of the die in the chamber of the second part with the chamber opening registered with the external opening of the first part;

d) introducing molten metal into the die cavity through the chamber opening;

e) solidifying molten metal in the die cavity;

f) removing the first part of the die from the second part after solidification, and cooling the first part independently of the second part before removing the solidified component from the first part; and g) providing a third part corresponding to the first part and repeating the steps (b) to (e) with the third part in place of the first part, wherein molten metal is introduced into the third part whilst cooling the first part independently of the second part.

2. A method according to claim 1, further comprising:

placing a fibre preform into the die cavity prior to introducing molten metal therein; and applying with a mechanical compaction piston pressure direct to molten metal introduced into the die cavity to encourage infiltration of the fibre preform prior to solidification.

3. A method according to claim 2, further comprising advancing the mechanical compaction piston towards the die cavity when applying pressure to molten metal in the die cavity.

4. A method according to claim 3, in which the mechanical compaction piston projects into the die cavity when applying pressure to molten metal in the die cavity.

5. A method according to claim 2, further comprising applying pressures in the range 400 bar to 2500 bar to molten metal in the die cavity during solidification using the mechanical compaction piston.

6. A method according to claim 1, in which the first and second parts of the die provided each comprise at least two sections so that each part may be split open, the method comprising placing the first part in the second part so that sections of one part are configured to separate in a different direction to sections of the other part.

* * * * *